United States Patent [19]

Walker-Arnott

[11] 4,037,708

[45] July 26, 1977

[54] MULTICOLOR INK RIBBON CONTROL FOR A TYPEWRITER

[75] Inventor: David A. Walker-Arnott, Bletchley, England

[73] Assignee: Xerox Corporation, Stamford, Conn.

[21] Appl. No.: 652,449

[22] Filed: Jan. 26, 1976

[30] Foreign Application Priority Data

Feb. 5, 1975 United Kingdom ..... 4950/75

[51] Int. Cl.[2] ..... B41J 33/20; B41J 31/00

[52] U.S. Cl. ..... 197/151; 197/160; 197/172

[58] Field of Search ..... 101/336; 197/151, 156–158, 197/160, 165, 172, 175, 180, 186 R

[56] References Cited

U.S. PATENT DOCUMENTS

| | | | |
|---|---|---|---|
| 880,375 | 2/1908 | Felbel | 197/172 X |
| 1,379,408 | 5/1921 | Holden | 197/175 X |
| 3,062,351 | 11/1962 | Canny | 197/160 |
| 3,356,202 | 12/1967 | Goff, Jr. | 197/151 |
| 3,603,443 | 9/1971 | McLean | 197/156 |
| 3,716,125 | 2/1973 | Ploeger, Jr. et al. | 197/172 |
| 3,752,291 | 8/1973 | Barouh et al. | 197/172 |
| 3,754,504 | 8/1973 | Clary | 197/151 X |
| 3,858,705 | 1/1975 | Reitano | 197/172 |
| 3,861,305 | 1/1975 | Sasaki | 197/172 X |
| 3,872,961 | 3/1975 | St. James | 197/172 X |

FOREIGN PATENT DOCUMENTS

| | | | |
|---|---|---|---|
| 1,238,935 | 4/1967 | Germany | 197/172 |
| 2,325,661 | 12/1974 | Germany | 197/151 |

*Primary Examiner*—Edgar S. Burr
*Assistant Examiner*—Paul T. Sewell

[57] ABSTRACT

A typewriter ribbon system comprising a ribbon drive device movable in response to the operation of a control device. The system allows the selection and printing of a specific longitudinal portion of a ribbon in the operative impact area.

10 Claims, 9 Drawing Figures

MULTICOLOR INK RIBBON CONTROL FOR A TYPEWRITER

BACKGROUND OF THE INVENTION

This invention generally relates to a color creation means and more particularly concerns a multicolor typewriter ribbon system which allows the rapid and convenient selection of different colored ribbon portions during typing.

Despite the increasing presence of color in almost all other areas of communications, e.g., advertising, photography, printed materials and television, the typewritten message has remained monochromatic. Although many outstanding advances have been made in recent times, which increase the monochromatic performance of tyepwriters, e.g., speed, dependability, type face selection and computer tape control (to mention a few), the color creation capability of tyepwriters has remained much as it was nearly a century ago.

Selection of a specific longitudinal portion of ribbon in the past has been inconvenient, if not difficult, according to known typewriter ribbon advancing arrangements. Specific means have not been provided for overriding the normal ribbon indexing mechanism to facilitate ribbon portion selection. Moreover, typewriter ribbons in the past have, to a large extent, been of a single color, e.g., black. Where more than one color was provided, they were arranged parallel to each other along the length of the ribbon. See, for example, U.S. Pat. Nos. 385,391, 855,559, 1,392,485, 2,759,580 and RE 27,770. These arrangements are limited by the special mechanisms required for moving the ribbon, carriage and type faces relative to each other. Thus, except for the two parallel machines, e.g., of the black-red variety, few machines having parallel colors are known to be in use. Even use of the former appears, in many cases, to be limited to accountants and bookkeepers who have need for red ink. As a result, color creation in typewritten documents has been extremely limited.

SUMMARY OF THE INVENTION

Accordingly, an object of this invention is to provide a typewritter ribbon system allowing the selection of any specific longitudinal portion of a ribbon to be present in the operative impact area of the typewritter. The system comprises a ribbon drive means operable to move the ribbon and a control means to operate the drive means to position the specific selected portion in the operative impact area.

According to a feature of the invention, the system includes a ribbon comprising more than two longitudinal segments of different characteristics, each segment being separated from the other by a barrier portion.

According to another feature of the invention, the barrier portions of the ribbon contain a signal means, and the control means are responsive to the signal means to control the position of the ribbon. The signal means may be coded to the characteristics of the adjacent ribbon portions and cooperate with the control means to initially position a selected portion in the impact area and then maintain the ribbon, which will be kept moving by the normal indexing mechanism, cycling back and forth through the impact area as long as required.

With the system of the invention, imaginative color creation of typewritten messages is limited basically by the ingenuity of the writer or user. Thus, it is now possible to provide, on new as well as existing typewriters, a means to type, upon easy selection, a wide number of different characteristics of color and function. For example, the ribbon may include the colors of red, blue, green, yellow, brown, black, cyan, magenta and provide functional portions for erase, stencil cutting, type cleaning, signalling, etc. Regardless of what color format is created, it is now possible, with the advent of the office color copier, to conveniently copy the papers typed in color so that the value of their effectiveness is not limited to the original.

Operation of the typewriter ribbon system by an operator may be manual with visual control over the characteristic selection or motorized with the touch of a switch producing the desired characteristic ribbon in the impact area.

BRIEF DESCRIPTION OF THE DRAWING

Still further objects and advantages of this invention will become apparent when the following detailed description is read in conjunction with the accompanying drawing.

DETAILED DESCRIPTION OF THE ILLUSTRATED EMBODIMENT

Figure 1:
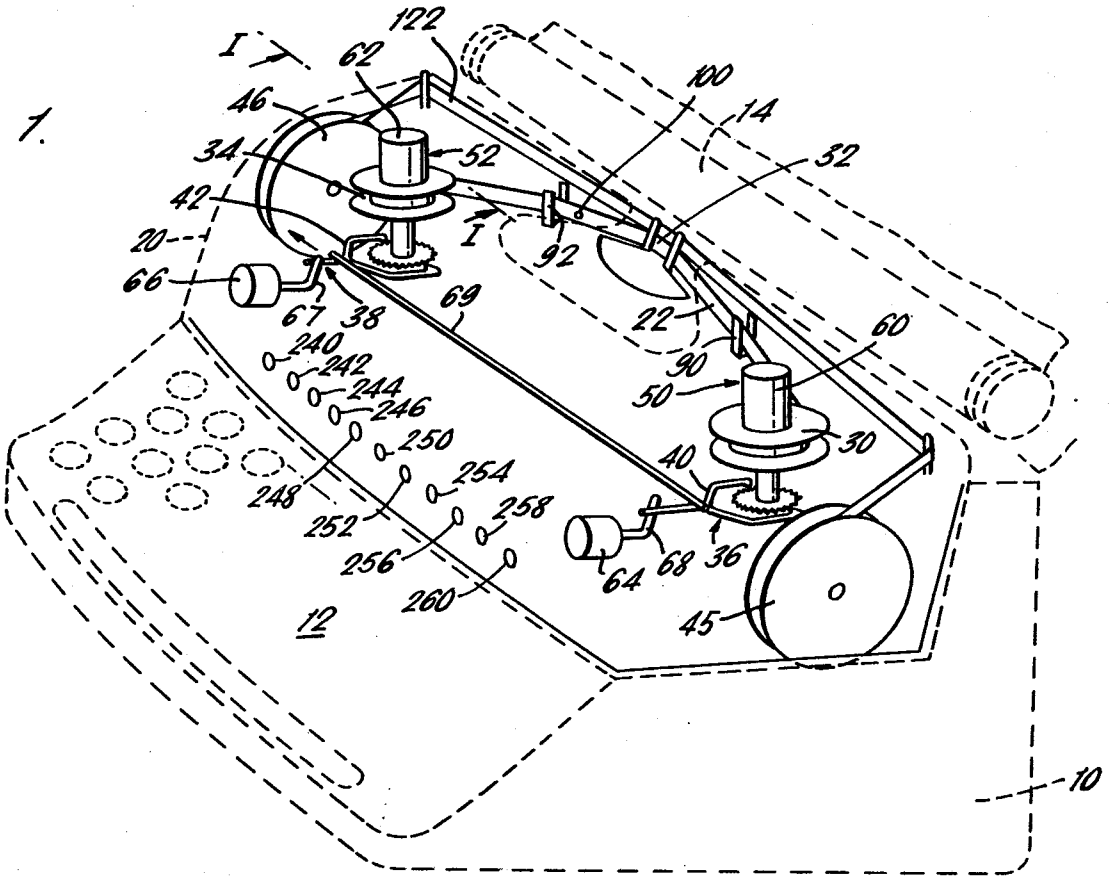
FIG. 1 is a perspective schematic view showing an embodiment of the apparatus of the invention on a typical typewriter.

Referring to the schematic perspective view of FIG. 1, there is illustrated a typical conventional typewriter chassis generally indicated at 10 having a removable cover portion 20 according to the invention. Each make of typewriter may have its own specific features and arrangements; nevertheless, the configuration shown is typical of the great majority of machines. To facilitate an understanding of FIG. 1, the conventional aspects have been drawn in dotted lines and generally the aspects of the invention are shown in full lines. It is a feature of the system that the function and construction of the chassis 10 including a keyboard assembly 12 and a carriage mechanism 14 are not changed or affected by the addition of the system according to the invention but that all components of the system with the exception of a ribbon 22 may be connected to the typical cover 20. With this arrangement, most standard typewriters having a removable cover portion may be converted to include the present inventive system with not much more time and effort than is required to change a ribbon. The typical chassis 10 will be understood by those skilled in the art and will be described only insofar as the portions thereof interelate with the invention. Thus, in the embodiment of FIG. 1, the ribbon 22 extends from a first standard type spool means 30 on one side of a common operative impact area 32 at which the key strikes the ribbon to a second standard type spool means 34 on the opposite side of the operative area 32. The ribbon is sequentially advanced and reversed in the usual manner by a typical ribbon indexing means schematically indicated at 36 for the first spool means 30 and at 38 for the second spool means 34. In practice, all indexing means allow overriding drive of the spool means 30, 34 and include a means for changing the direction of ribbon movement such as is represented by the ratchet and linkage arrangements 40, 42, respectively.

In the embodiment of FIG. 1, the portions of the system supported on the cover 20 comprise a first and second ribbon drive means generally indicated at 50, 52, arranged adjacent the first and second spool means 30, 34, respectively; and a corresponding control means represented by the switch 60, 62, which operates the drive means 50, 52, respectively, to position a specific selected portion of the ribbon 22 in the operative impace area 32.

An index reversing means here represented by the solenoids 64, 66 is connected with the control means 60 and 62 to allow complete direction control of the ribbon as will be set forth hereinafter in greater detail.

The drive means 50, 52 may be of any suitable power source including, but not limited to, a hand crank, a spring clockwork-type mechanism and an electric motor. For example, for manual typewriters receiving infrequent use, the drive means could be of a clockwork type wound by either hand or by the carriage drive spring. Alternatively, the drive means may be battery operated, rotary or linear electric motors. In electric typewriters, advantage may be taken of the supply to the machine and main operating motors, preferably via a transformer which would operate similar to the battery motors.

As shown, two drive means 50, 52 are required with drive 50 providing clockwise rotation and the drive 52 providing counterclockwise rotation to their respective spool means.

Figure 2:
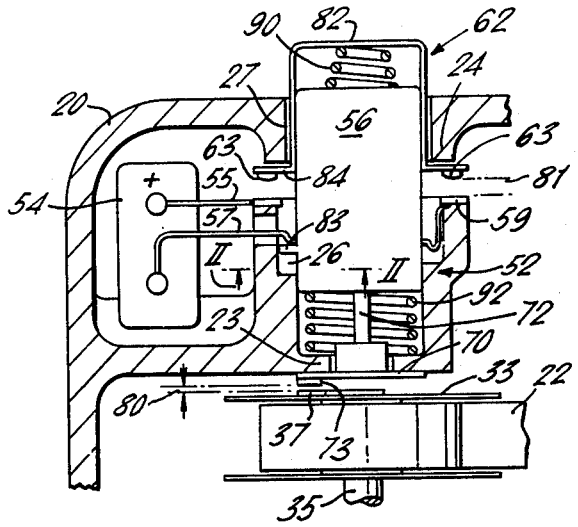
FIGS. 2, 3 and 4 are schematic cross-sectional views as would be shown by a section taken along a line such as I—I in FIG. 1 showing the operation of the apparatus with FIG. 2 illustrating the position during normal typing, FIG. 3 showing how the initial push on the control portion engages the clutch with the spool means, and FIG. 4 setting forth energization of the motor upon further movement of the control means.
Figure 3:
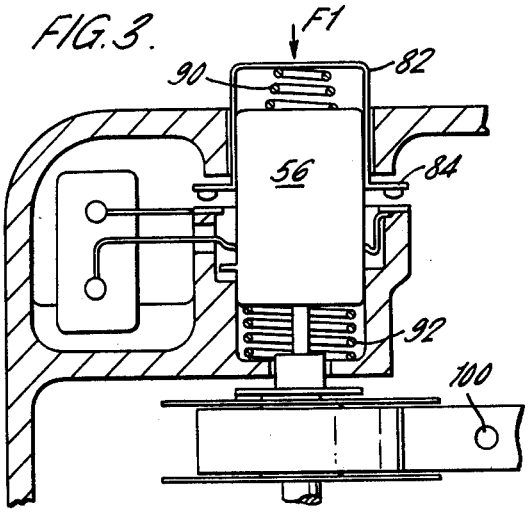
Figure 6:
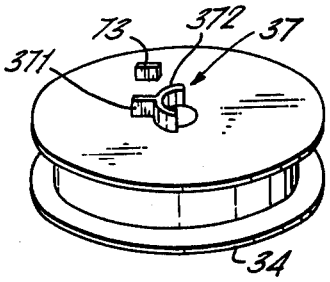
FIG. 6 is a schematic perspective view of an embodiment of a spool means.
Figure 4:
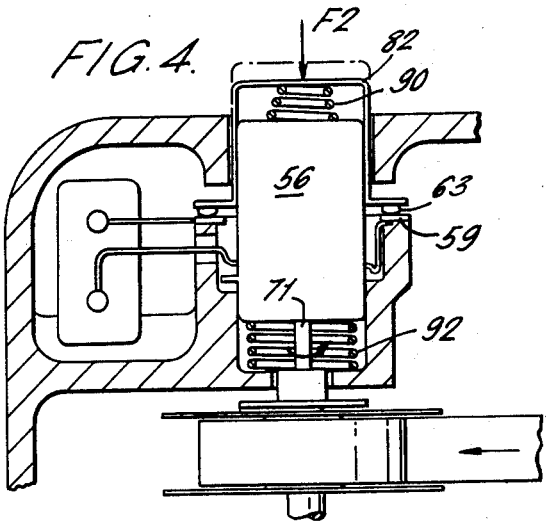

An electric drive means 56 shown in FIG. 2–4 is capable of supplying rotary motion to the second spool means 34 through a suitable connection such as a clutch means 70 coupled to the drive means by a shaft 72. In this embodiment, the clutch 70 is positioned for rotation in a plane generally parallel to the plane of rotation of the spool means 34 and generally concentric therewith. Thus, the axis of shaft 72 is aligned with the axis of a shaft 35 of the spool means 34. While a wide variety of clutch and spool interconnections are possible, we have found that a positive mechanical engagement may be preferred in many situations. In FIGS. 2 and 6, there is provided a projection 37 on the upper surface 33 of the spool means extending in a first direction toward the clutch 70 and a projection 73 on the clutch means 70 extending in the opposite direction toward the upper surface 33 and in rotary alignment with the projection 37. In FIG. 2, the spacing 80 between the clutch 70 and the surface 33 is greater than the combined heights of the projection 37 and 73 so that the spool means 34 may rotate as required during normal operation of the typewriter.

It will be noted that the motor 56 is held in a vertically movable floating position between a first helical spring 90 and a second helical spring 92. The end of the first spring 90, which does not contact the motor 56, is restrained by a cup-shaped switch cap 82 that fits in a cylindrical opening 27 in the cover 20 and surrounds the upper portion of the cylindrically shaped motor 56. The cap 82 has an outwardly projecting lip 84 whose upper edge is urged by the upward force of the spring 90 against a portion 24 of the cover as shown in FIG. 2.

Figure 5:
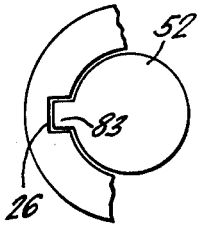
FIG. 5 is a schematic cross-sectional view of a drive means as would be seen by taking a section along a line such as shown by II—II in FIG. 2.

The second spring 92 is confined between the bottom of the motor 56 and a portion 23 of the housing 20. The spring constant of spring 90 is greater than spring 92 so that spring 92 will compress more quickly than will spring 90. In this arrangement, the motor and its attached clutch 70 and shaft 72 may move vertically along the axis of the opening 27 toward and away from the spool means 34. A key 83 projecting from the motor 56 rides in a slot 26 to prevent rotation of the motor as shown in FIG. 5.

The electric current to run the motor 56 may be standard outlet voltage or, preferably for safety reasons, a lower voltage such as would be supplied by a battery means represented at 54. For purposes of illustration, the battery is shown housed in the cover 20; however, it will be understood that other and various equivalent arrangements may be provided.

Current from any source is supplied to the motor 56 by suitable leads and contacts 55, 57 and 59 through a conductive contact 63 extending at least halfway around the lip 84 of the microswitch cap 82. The contact lead 59 includes a flexible looped portion that is connected to the motor 56.

Operation of the drive and switch control means may be understood by comparing FIGS. 2, 3 and 4 in sequence. Thus, in FIG. 2, which represents the position of the various elements during normal typing when the ribbon 22 is being driven by the conventional typewriter mechanism (not shown), the clutch 70 is spaced from the upper portion 37 of the ribbon spool means 34 by a distance 80 and the switch contact 63 is spaced from the inlet lead contact 55 and motor lead contact 59 by a distance 81.

FIG. 3 represents the position of the elements of FIG. 2 after a force F1 has been applied to the switch cap 82 shown. This force was sufficient to compress the springs 90 and 92, with spring 92 compressing more than spring 90, such that the drive means 56, 70, 72 were moved downwardly until the projection 73 on the clutch meshes with the projection 37 on the spool means in a manner sufficient to transmit rotary motion therebetween. It will be noted that the switch contacts have not yet closed to energize the motor. This sequence, which is caused by the spring 90 having a higher constant than spring 92 and by the fact that the electrical contact spacing 81 is greater than the clutch spacing 80, assures that the drive means 52 is in full engagement with the spool means 34 before power is supplied and provides smooth, trouble-free operation. If this sequence is not followed on startup, a very rapidly spinning clutch 70 would suddenly engage a stationary spool and give a sharp jerk to the ribbon putting a strain on the ribbon and possibly causing the ribbon to go loose and form buckles along its length. The disclosed arrangement assures that the inertia of the motor is employed to slow the spool down after the motor contact is broken and thereby avoids the problems of overrun caused by a sudden stop.

The full operative position shown in FIG. 4 is reached after a force F2 has been applied which is sufficient to cause the switch contact 63 to close the gap 81 and complete the circuit 54, 55, 63, 59, 56, 57, 54 thereby energizing the motor and causing the spool means 34 to rotate in the direction indicated by the arrow 71. As shown, this will cause the ribbon 23 to wind on spool means 34 and move past the operative area 32 to the left indicated by the arrow 76.

While FIGS. 2–4 have described only the drive and control means 52, 62, respectively, shown on the left side of FIG. 1, it will be understood that the right side drive and control means 50, 60 will be substantially a mirror image and serve to wind the ribbon 22 on spool 30 and cause it to pass the operative area 32 moving to the right as seen in FIG. 1.

Figure 7:
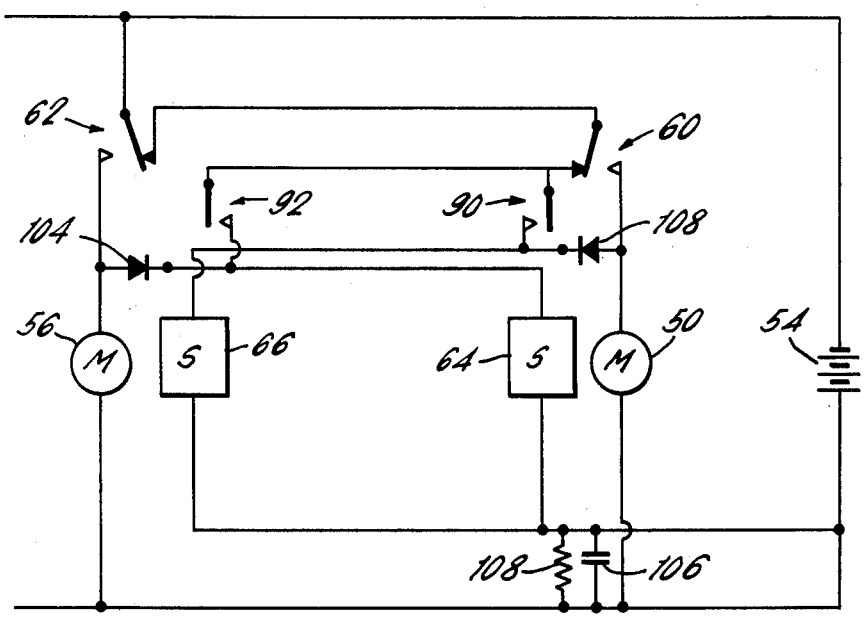
FIG. 7 is an electrical circuit of the apparatus.

In the electrical embodiment shown in FIGS. 2–4, the control means includes a further ribbon direction changing means represented by the solenoid means 66. Thus, when the control switch 82 is engaged and the contact is made to energize the motor, a further circuit is completed as is shown in FIG. 7 which includes the solenoid 66. The closing of this circuit energizes the solenoid 66 causing it to rotate a lever 67, as is shown in FIG. 1, counterclockwise. The lever 67 bears against a portion of the ribbon indexing mechanism linkage 42 to assure that the standard ribbon indexing mechanism is set to have the ribbon move to the left regardless of the way it may have previously been moving.

Similarly operating the control means 60 energizes solenoid 64 to rotate lever 68 clockwise and move the typical ribbon indexing mechanism linkage 40 allowing the ribbon to move to the right. When one spool means is set to wind, the other spool must be set to unwind and hence a control bar 69 is conventionally used to assure this synchronization.

To accommodate possible small variances in the positioning of the spool means in machines of the same or different make, the clutch 70 is provided with a bit of freedom in the opening in cover portion 23 to shift to align its axis with the axis of the spool means. To assist in this alignment, the projection 37 on the spool may take the form as is shown in FIG. 6. In this case, in addition to projection 371, there is provided a semicircular self-aligning guide portion 372. Thus, if the clutch and spool are not co-axial, the projection 73, which is spaced to just miss the outer surface of portion 372, will engage the outer surface and urge the two units into alignment.

For automatic operation, the system includes automatically actuatable drive means. For example, solenoids not shown may be arranged to cooperate with the drive means to apply the equivalent of the pressures F1, F2 shown in FIGS. 3 and 4 to couple the drive means to the spool means.

It will be understood that although the drive means has been shown positioned co-axial with the spool means, other arrangements accomplishing the same result are contemplated. For example, the drive means may be a disc (not shown) which is inclined 90 degrees to the spool so that its edge is brought to bear against the spool to rotate it. Suitable means may be employed to effect the pressure contact with the spool.

It is also contemplated by the present system that the drive means may include a single motor with suitable gearing to alternately drive both separate reels as shown in FIG. 1. Where a cartridge is used having a single drive axis, only one motor would be required and used.

With the drive and control means described in conjunction with FIGS. 2–4, it will be understood that for a typewriter user to override the standard built-in ribbon indexing and to move the ribbon 22 to the left through the operative impact area 32, it is only necessary that the switch 82 be depressed as long as is necessary for a desired portion of ribbon 22 to appear in the operative area 32. Similarly, movement of the ribbon to the right to any extent desired may be effected by depressing the equivalent switch portion of control means 60 as long as is necessary. Accordingly, when a ribbon of multiple characteristics, as will hereinafter be disclosed, is used, the operator may quickly and conveniently change the ribbon characteristics during typing. With the great freedom of choice offered by this system, color creation is encouraged and stimulated.

Figure 8:
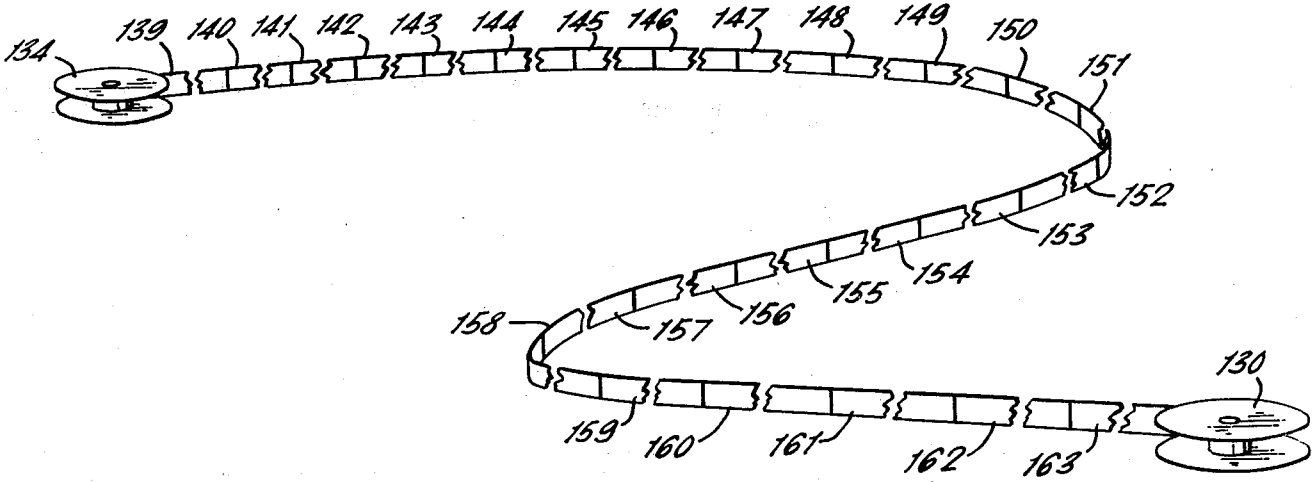
FIG. 8 is a schematic representation of a ribbon arrangement used in the system.

The typewriter ribbon as set forth herein comprises more than two longitudinal segments, each having different characteristics of color or function with each such segment being separated from the other by a barrier portion. For example, in the embodiment shown in FIG. 8, the ribbon 122 extending between the spool means 130, 134 may comprise, from left to right, end barrier 139, black 140, barrier 141, red 142, barrier 143, blue 144, barrier 145, green 146, barrier 147, brown 148, barrier 149, erase 150, barrier 151, yellow 152, barrier 153, cyan 154, barrier 155, magenta 156, barrier 157, erase 158, barrier 159, cleaning 160, barrier 161, black 162 and end barrier 163.

The specific arrangement of functions and colors is only exemplary and may be varied in accordance with developing patterns of color and function usage. Thus, as shown, the black portion may be positioned at the ends of the ribbon with the colored portions generally in the center. Alternatively, of course, portions of black may be interspersed throughout the colored portions. Quick access to the longitudinally spaced colored and functional portions at any time is an important aspect of the distribution arrangement.

In another embodiment of the system adapted for typewriters having a black-red capability accommodating ribbon divided along its length into red and black (for example, as set forth in U.S. Pat. No. 855,559), the multicharacteristic ribbon arrangement described above could be included in place of the "red" half of the ribbon. This would allow quick access to a black ribbon portion in the operative impact area regardless of the specific color-function arrangement.

Where the typewriter includes a two-ribbon system (as is suggested in FIG. 1 by the second ribbon 122 extending between a pair of vertically disposed spools 45, 46), the second ribbon 122 may be all black in which case the ribbon 22 need not include any black or "normal" typing color. It will be understood that the reference to black is used by way of example herein to refer to the normal single color used in typing and that all other single ribbon colors are intended to be included in that representation.

The length of the different colored portions may be adapted to compensate for normal usage patterns. Thus, if, for example, blue is found to be frequently used, the length and/or occurrence of the blue portions may be increased to provide an adequate and convenient supply. In practice we have found that a colored segment ten inches in length provides excellent results under a wide variety of situations.

The barrier portions 139, 141, 143, 145 et seq. serve a number of important functions. One of these is to prevent bleeding of one color to another when the colored ribbon portions are of the multistrike, self-healing variety. For this purpose, the barrier portion is of a material which does not absorb, transmit or retain normally used ribbon inks. It should be of a length at least equal to the maximum spooling circumference between the colored portions, i.e., at least pi times the maximum spool diameter. For most conventional-sized typewriter spools, a barrier of approximately six inches has been found to be adequate. In U.S. Pat. No. 3,716,125 a single connector strip at the center of a ribbon separates the two halves.

In addition, however, the barrier portions of ribbon 22 herein function as a part of the ribbon control means by signalling at least the limit of a particular portion and may also signal its characteristic, direction, etc. Thus, in one form of the invention where the operator visually controls the position of the ribbon, the barrier provides a visual indication that the end of the selected color is near in which case the operator can act accordingly. The barrier may also be made of a material which will provide a noticeably different sound when struck that the colored portion in which case the operator will be alerted by a change in sound that the selected color is no longer in the impact area. Because the barrier portion preferably does not carry any ink, the symbols struck on the barrier portion will not transmit anything to the document being created and hence the operator may quickly take up where he left off after adjusting the ribbon as desired. Alternatively, it is possible to have the barrier overlap and cover the end of the colored portion on the outside of the tape facing the operator so that although the barrier has moved into the operative impact area, the selected color will still be typed for a short distance before the non-inked barrier is struck. Other variations in construction are within the contemplation of the invention. In practice a barrier strip construction of a lacquer-coated nylon has been found to be more effective than molinex-type material in that the former produces no static and prevents ink adherence.

In the automatic mode of operation, the ribbon barrier portions are coded with suitable signal means that are detected by a sensor portion of the control means to provide information as to the characteristic of the ribbon section which is preceded or followed by the uninked barrier section. For example, the barrier may have punched holes, metallic insertions, different surface textures, machine-readable indicia, etc. Depending on the nature of the signal means, the sensors may be magnetic, electro-optical, mechanical, etc., an may be suitably placed. While it is preferred that the sensors be mounted on the cover, they may be positioned in whole or in part on the typing machine, in or on the ribbon cassette, etc.

Figure 9:
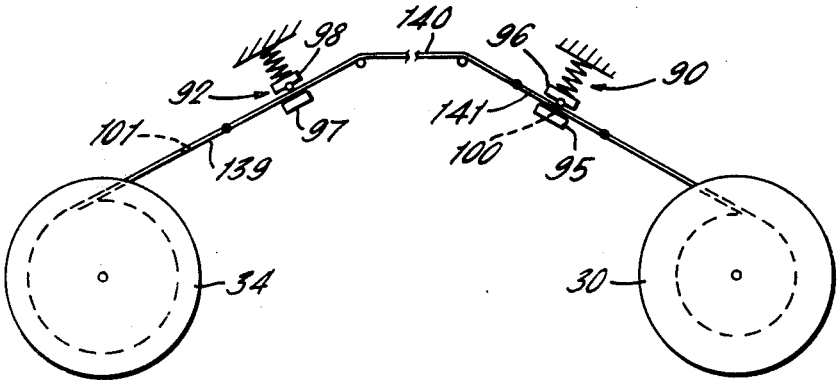
FIG. 9 is a plan view of a ribbon and signalling means.

In practice we have found that a punched hole 100 as is shown in FIGS. 1, 3 and 9 provides a reliable signal when combined with an electro-mechanical sensing means 90, 92 positioned on opposite sides of the impact area 32. Each of the sensing means 90, 92 takes the form of a pair of electrical contacts 95, 96 as shown in FIG. 9 on opposite sides of the ribbon. The contacts 95, 96 are aligned and biased toward one another so that the appearance of the hole 100 will allow them to touch. Alternatively, a signal may be produced with a light source on one side of the ribbon and a light sensor such as a photo-electric cell on the other side.

The resulting signal may be used to control the tape in various ways. Thus, it may cause the ribbon indexing mechanism to reverse the direction of movement of ribbon 22 so that the selected portion is recycled back through the impact area 32. A similar signalling means 101 located in the barrier at the other end of the segment cooperating with a similar sensor 97, 98 will, according to a predetermined control program, continue repeating the reversal to keep the selected portion cycling through the impact area until a new color or function is selected.

The signal means may take various forms. A single opening in the center of the barrier, such as shown at 100, 101 in FIG. 9, functions very well. The signal means may also include two openings with one located at each end of the barrier closer to the colored portions of the ribbon on opposite sides of the barrier or it may include a plurality of openings of different size, arrangement and configuration.

The signal means may include coding so that a unique signal is generated for each ribbon portion having a different characteristic. Whatever the particular signal means selected, the control of the ribbon to select a portion having a different characteristic may be readily effected by control means including switches or programmable circuits responsive to the pulses signalled. Thus, a switch including a button or key for each different ribbon characteristic may be included on the cover 20 in a convenient form and arrangement. As shown in FIG. 1, a plurality of push buttons bearing even numbers 240–262 represent the characteristics of the different portions of the ribbon set out in FIG. 8 corresponding to the numbers having the same last two digits. Selection of the specific ribbon portion desired in this case is effected by simply touching and thereby activating the button representing the desired characteristic. For example, actuation of the button 244 will cause the blue portion 144 to appear in the impact area, touching button 258 will cause the erase portion 158 to appear, etc. Where more than one portion has the same characteristic, the control means may be programmed to cause either to appear. In most cases, however, the portion closest to the impact area will appear. In the automatic mode, the system of the invention is compatible with programmable, tape-driven word-processing machines. Thus, during generation of the input tape, activation of the characteristic selection button will be recorded on the tape along with the other typing signals and serve to automatically position the ribbon during playback. Compatible high-speed drive means are used as required by the tape-controlled word-processing machines.

The electrical interrelationships between the elements will be understood by reference to the schematic circuit of FIG. 7. As shown when switch 62 is closed, current from the power source, shown as battery 54, passes through motor 56 and through a diode 104 to solenoid 64. Where a low current source, such as a six-volt battery, is used, a capacitor 106 provides the initial boost of current to assure activation of the solenoid. Subsequent power for the solenoid is obtained by flow of current through the resistor 108. Similarly, closure of switch 60 activates motor 50 and solenoid 66. It will be noted that switch 62 must be fully open before current can flow through switch 60. With both switches 60 and 62 open, the closure of the automatic sensor switches 90, 92 in response to signal means on the ribbon will cause the respective solenoids 64, 66, respectively, to be actuated to change the ribbon direction. In each case, when the sensor switches are activated, the diodes 108, 104, respectively, will prevent power from flowing to the motors. This automatic sensor arrangement will cause the direction of the normally driven ribbon 140, as shown in FIG. 9, for example, to keep reversing when the signalling means 100, 101 in the barrier portion 141, 139, respectively, on opposite sides of the colored or functional portion 140 are alternately detected by the sensor means 90, 92, respectively.

As used herein, the term "spool means" or its equivalent is intended to include all means of storing a typewriter ribbon where the color and functional characteristics of the ribbon portions may be preserved during periods when it is not in the impact area. Thus, the term embraces ribbon on separate spools adapted for reel-to-reel travel, cartridges with one or two spools, "endless" or continuous run cartridges where two reels turn on the same axis, single spool cartridges, etc.

From the foregoing it will be appreciated that the monochromatic limitations of the prior art have been greatly overcome and that color creation of documents is greatly facilitated with the wide range of compact typewriter cover attachments embodying the system, each including a ribbon overdrive and control means to allow the operator to override the normal ribbon movement and position a selected portion of multicharacteristic ribbon in the impact area. The wide range of adaptability allows the system to accommodate most machines. It will also be understood that various modifications may be made to the specific details referred to herein without departing from the scope of the invention herein and as defined in the appended claims.

What is claimed is:

1. A typewriter ribbon system to enable selection of any specific longitudinal portion of a ribbon to be present in the operative impact area of the typewriter, comprising:

a ribbon including more than two longitudinal portions of different characteristics, each portion being separated from the other by a barrier portion, said ribbon extending from a first spool means on one side of said operative area to a second spool means on the opposite side of said operative area, a ribbon drive means arranged adjacent each spool means and connectable thereto to drive a respective spool means, each said ribbon drive means being alternately operable to move said ribbon through said operative area, said ribbon drive means includes a motor and a clutch held between first and second resilient means, said motor and clutch being movable to move said clutch into and out of engagement with said spool means, and a control means to operate said drive means to position a selected portion of said ribbon in said operative impact area.

2. A typewriter ribbon system as defined in claim 1 wherein said motor and clutch rotate about an axis which is generally aligned with the axis of rotation of said spool means, said clutch and spool means having intermeshing self-centering portions assuring the axial alignment of motor, clutch and spool means.

3. A typewriter ribbon system as defined in claim 2 wherein said first resilient means is positioned between an electrical contact carrying switch cap and one end of said motor, said second resilient means being retained between the opposite end of said motor and a fixed support, said first resilient means having a higher spring constant than said second resilient means whereby said motor and clutch travel further to engage said spool means than said switch cap contact travels to energize said motor.

4. A typewriter ribbon system to enable selection of any specific longitudinal portion of a ribbon to be present in the operative impact area of the typewriter, comprising:

a ribbon including more than two longitudinal portions of different characteristics, each portion being separated from the other by a barrier portion, a ribbon drive means operable to move said ribbon, and a control means to operate said drive means to position a selected portion of said ribbon in said operative impact area, said barrier portion of said ribbon includes a signal means and said control means being responsive to said signal means to control the position of said ribbon.

5. A typewriter ribbon system as defined in claim 4 wherein said signal means includes an opening in a predetermined position in said barrier portion.

6. A typewriter ribbon system as defined in claim 5 wherein said control means includes a pair of electrical contacts positioned on opposite sides of said ribbon and biased toward each other to touch when said opening appears.

7. A typewriter ribbon system as defined in claim 5 wherein said control means includes a light source on one side of said ribbon and a light sensitive member on the other side, and light sensitive member being activated by said lightshowing through said opening in said barrier portion.

8. A typewriter ribbon system as defined in claim 4 wherein said signal means cooperates with said control means to maintain the same longitudinal portion in the operative impact area regardless of the length of ribbon of the selected characteristic required for typing.

9. A typewriter ribbon system as defined in claim 4 wherein said signal means includes a detectable irregularity in the surface of said ribbon, said control means being responsive to said irregularity to control the position of said ribbon.

10. A typewriter ribbon system to enable the selection of any specific longitudinal portion of a ribbon to be present in the operative impact area of the typewriter, comprising:

a ribbon having more than two longitudinal portions of different characteristics, each portion being separated from the other by a barrier portion, said ribbon extending from a first spool means on one side of said operative area to a second spool means on the opposite side of said operative area, a ribbon drive means arranged adjacent each spool means and connectable thereto to drive a respective spool means, each said ribbon drive means being alternately operable to move said ribbon through said operative area, said ribbon drive means includes a motor and clutch, said motor and clutch being movable to move said clutch into and out of engagement with said spool means to transmit rotary drive from said motor to said spool means, and a control means to operate said drive means to position a selected portion of said ribbon in said operative impact area, said control means includes a manually movable switch means supported for movement with said drive means for energizing said drive means, whereby movement of said switch means and said drive means in a first direction for a first predetermined distance engages said clutch with said spool means and further movement in said first direction for a second predetermined distance energizes said ribbon drive means and whereby subsequent movement of said switch means and said drive means in a second and opposite direction for second predetermined distance de-energizes said ribbon drive means and further movement in said second direction for said first predetermined distance dis-engages said clutch with said spool means.

* * * * *